US011892238B2

(12) United States Patent
Ahmed

(10) Patent No.: US 11,892,238 B2
(45) Date of Patent: Feb. 6, 2024

(54) HEAT PIPE COOLED PALLET SHIPPER

(71) Applicant: Sonoco Development, Inc., Hartsville, SC (US)

(72) Inventor: Iftekhar Ahmed, Pierrefonds (CA)

(73) Assignee: Sonoco Development, Inc., Hartsville, SC (US)

( * ) Notice: Subject to any disclaimer, the term of this patent is extended or adjusted under 35 U.S.C. 154(b) by 734 days.

(21) Appl. No.: 16/891,404

(22) Filed: Jun. 3, 2020

(65) Prior Publication Data

US 2020/0377279 A1 Dec. 3, 2020

Related U.S. Application Data

(60) Provisional application No. 62/856,203, filed on Jun. 3, 2019.

(51) Int. Cl.

| | |
|---|---|
| ***F28D 15/02*** | (2006.01) |
| ***F25D 11/00*** | (2006.01) |
| ***F28D 15/00*** | (2006.01) |

(52) U.S. Cl.

CPC ..... *F28D 15/0233* (2013.01); *F25D 11/003* (2013.01); *F28D 15/00* (2013.01); *F28D 15/0275* (2013.01)

(58) Field of Classification Search

CPC .... F25D 11/003; F28D 15/0233; F28D 15/00; F28D 15/0275; F28D 20/026; F28D 20/021; F28D 2020/0026

See application file for complete search history.

(56) References Cited

U.S. PATENT DOCUMENTS

| | | | | |
|---|---|---|---|---|
| 5,000,252 | A * | 3/1991 | Faghri | F28D 20/023 165/41 |
| 5,355,684 | A | 10/1994 | Guice | |
| 6,104,611 | A * | 8/2000 | Glover | F28D 15/0275 165/104.33 |
| 6,542,359 | B2 * | 4/2003 | Babcock | G06F 1/203 174/15.2 |
| 6,642,485 | B2 * | 11/2003 | Goenka | B23K 3/087 219/400 |
| 7,043,935 | B2 * | 5/2006 | Hunter | F25D 3/125 62/457.2 |
| 7,597,133 | B2 | 10/2009 | Lee et al. | |
| 8,024,936 | B2 * | 9/2011 | Storm | F28F 13/14 62/3.61 |
| 8,468,837 | B2 | 6/2013 | Pinet | |
| 10,030,913 | B1 * | 7/2018 | Cao | F28D 15/0275 |
| 11,408,379 | B2 * | 8/2022 | Löwstedt | F02M 35/086 |
| 11,572,227 | B2 * | 2/2023 | Pranadi | B65D 19/06 |
| 2003/0029174 | A1 | 2/2003 | Lee | |

(Continued)

FOREIGN PATENT DOCUMENTS

WO 2007033051 A2 3/2007

*Primary Examiner* — Len Tran
*Assistant Examiner* — Gustavo A Hincapie Serna
(74) *Attorney, Agent, or Firm* — von Briesen & Roper, s.c.

(57) ABSTRACT

A packaging system for transporting a payload while maintaining the payload within an acceptable temperature range. The payload is cooled by two sets of U-shaped heat pipes within the payload compartment. A set of cold heat pipes is cooled by a layer of phase change material located above the payload, while a set of warm heat pipes is cooled by a layer of phase change material located below the payload.

10 Claims, 4 Drawing Sheets

(56) References Cited

U.S. PATENT DOCUMENTS

| | | | | |
|---|---|---|---|---|
| 2015/0159924 | A1* | 6/2015 | Calderon | F25D 11/006 62/3.6 |
| 2015/0237762 | A1* | 8/2015 | Holt | F28D 15/02 29/890.032 |
| 2015/0239639 | A1 | 8/2015 | Wenner | |
| 2016/0251140 | A1 | 9/2016 | Wengreen et al. | |
| 2016/0362240 | A1* | 12/2016 | Ferracamo, Jr. | A61J 1/165 |
| 2017/0303433 | A1* | 10/2017 | Delano | G06F 1/206 |
| 2017/0303441 | A1* | 10/2017 | Farshchian | F28F 21/089 |
| 2017/0307302 | A1* | 10/2017 | Jacobs | F28D 20/021 |
| 2018/0171197 | A1* | 6/2018 | Ma | B65D 51/24 |
| 2018/0287231 | A1* | 10/2018 | Iyengar | H01M 50/24 |
| 2020/0056858 | A1* | 2/2020 | Vabnick | F42B 33/062 |
| 2020/0166290 | A1* | 5/2020 | Gattuso | F28D 20/0034 |
| 2021/0288361 | A1* | 9/2021 | Biel, Jr. | H01M 10/6552 |
| 2021/0310749 | A1* | 10/2021 | Guillen Martinez | F25D 11/006 |
| 2021/0331834 | A1* | 10/2021 | Longley | B65D 81/3897 |
| 2022/0333840 | A1* | 10/2022 | Chasteen | B65B 55/00 |

* cited by examiner

HEAT PIPE COOLED PALLET SHIPPER

BACKGROUND OF THE INVENTION

Field of the Invention

This disclosure relates to a packaging system for transporting a payload while maintaining the payload within an acceptable temperature range. More particularly, this disclosure relates to a packaging system for transporting a payload wherein the payload is cooled by two sets of heat pipes that run along the interior walls of the payload compartment.

Description of the Related Art

Currently the shipment of temperature controlled products is achieved through the use of insulated packaging that contains a large amount of conditioned phase change materials, typically in the form a bottles filled with the phase change material ("PCM bottles"). Usually the PCM bottles are single use materials and are not practicable for reuse. Also, the use of PCM bottles can result in unwanted temperature gradients (changes) within the payload area.

The present disclosure is intended to address these issues.

BRIEF SUMMARY OF THE INVENTION

The present disclosure generally relates to a packaging system for transporting a payload while maintaining the payload within an acceptable temperature range. The payload is cooled by two sets of heat pipes that run along the interior walls of the payload compartment. A set of cold heat pipes is cooled by a layer of phase change material located above the payload, while a set of warm heat pipes is cooled by a layer of phase change material located below the payload.

In one aspect the disclosure relates to a packaging system comprising a housing, a temperature control system comprising at least two arrays of heat pipes and layers of phase change material in thermal contact with the heat pipes.

The housing may comprising a bottom wall, a top wall located above and in spaced vertical alignment with the bottom wall, and side walls extending vertically between the bottom wall and the top wall. The housing defines a payload compartment for holding a payload.

The temperature control system comprises one or more arrays of cold heat pipes, one or more arrays of warm heat pipes, a top layer of cold phase change material (PCM) and a bottom layer of warm PCM material. The payload is cooled or warmed by the heat pipes that run along the interior walls of the payload compartment.

Each array of cold heat pipes is located within the housing and comprises one or more cold heat pipes. Preferably, each cold heat pipe is shaped like an inverted "U" and comprises a horizontal section connecting two downwardly extending vertical sections. A first "cold" phase change material is located within each cold heat pipe and is conditioned to a first temperature. The top layer of cold phase change material is in thermal contact with the horizontal section of each cold heat pipe.

Similarly, each array of warm heat pipes is located within the housing and comprises one or more warm heat pipes. Preferably, each warm heat pipe is shaped like a "U" and comprises a horizontal section connecting two upwardly extending vertical sections. A second "warm" phase change material is located within each warm heat pipe and is conditioned to a second temperature that is warmer than the first temperature. The bottom layer of warm phase change material is in thermal contact with the horizontal section of each warm heat pipe.

In another aspect a packaging system is described comprising a housing, a cooling system and a refrigerant. The housing comprises an internal wall separating a payload compartment from a refrigerant compartment. The cooling system comprises an array of heat pipes arranged in a parallel array, the array of heat pipes located within the housing. Each heat pipe comprises a lower horizontal section having an end located in the refrigerant compartment, an upper horizontal section located in the payload compartment and a vertical section connecting the lower horizontal section to the upper horizontal section. The lower horizontal section functions as the evaporation section and the higher horizontal section functions as the condensation section of the heat pipes. The refrigerant comprises one or more phase change bottles located in the refrigerant compartment adjacent to and in thermal contact with the lower horizontal heat pipe section.

DETAILED DESCRIPTION OF THE INVENTION

Figure 1:
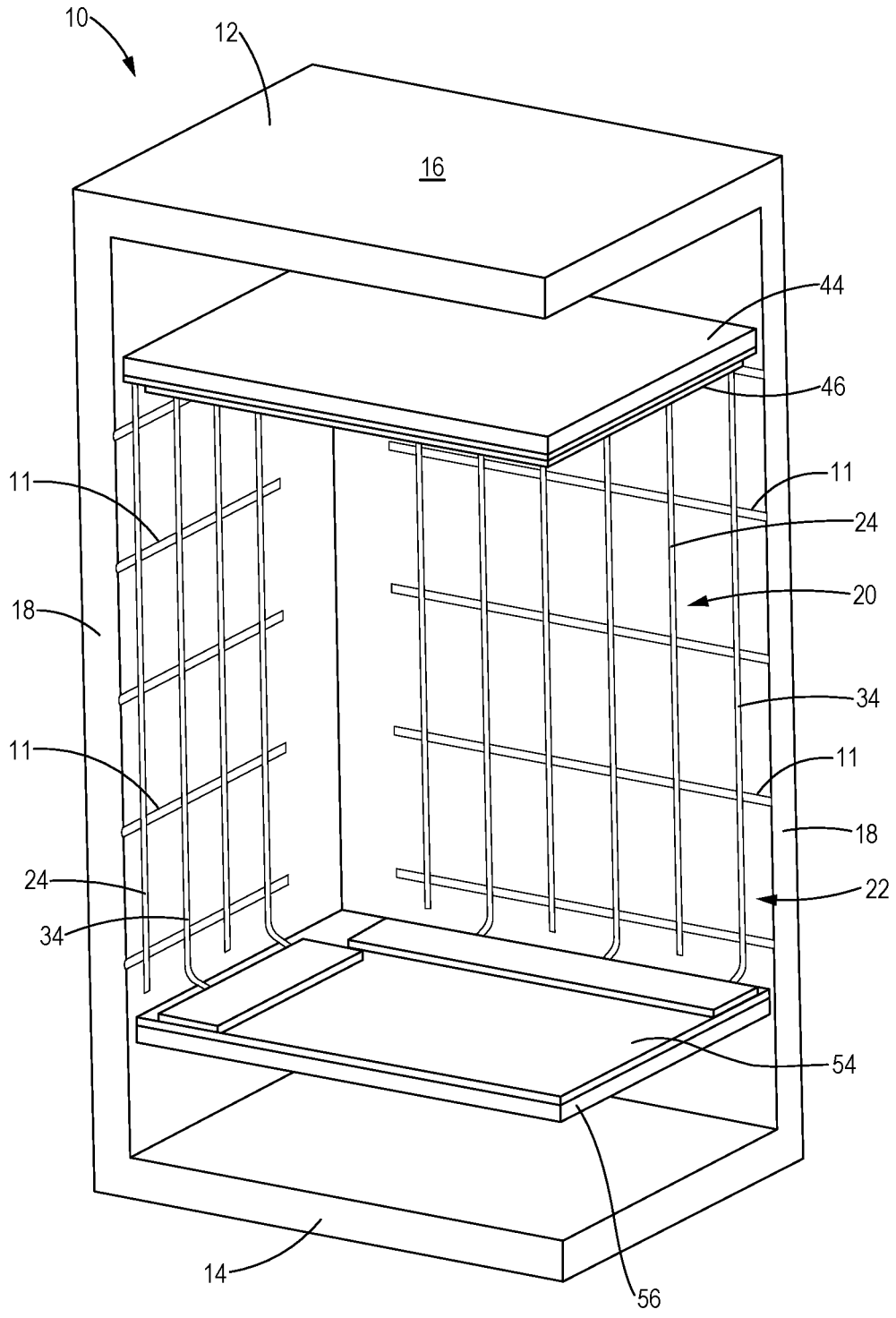
FIG. 1 is cutaway perspective view of a compartment uarter portion of a packaging system according to the disclosure.

While the invention described herein may be embodied in many forms, there is shown in the drawings and will herein be described in detail one or more embodiments with the understanding that this disclosure is to be considered an exemplification of the principles of the invention and is not intended to limit the disclosure to the illustrated embodiments. Aspects of the different embodiments can be combined with or substituted for one another.

As will be appreciated, terms such as "above" and "below", "upper" and "lower", "top" and "bottom," "front" and "back," (etc.), used as nouns, adjectives or adverbs refer in this description to the orientation of the structure of the wrapper as it is illustrated in the cross sectional views. Such terms are not intended to limit the invention to a particular orientation.

As used herein the term "warm heat pipes" means that the PCM in the heat pipes is conditioned to a temperature that is warmer then the PCM in the cold heat pipes. For example, the cold PCM may be conditioned to a temperature of, say, 5 degrees C. and the warm PCM may be conditioned to a temperature of 23 degrees C. (i.e., room temperature).

The disclosure relates to a packaging system for transporting a payload while maintaining the payload within an acceptable temperature range. The payload may be cooled or warmed by two sets of U-shaped heat pipes that run along the interior walls of the payload compartment. A set of cold heat pipes is cooled by a layer of phase change material located above the payload, while a set of warm heat pipes is cooled by a layer of phase change material located below the payload. The entire cooling process is "passive", meaning it does not recompartment uire a battery or other electrical power.

FIG. 1 is a perspective view of a compartment uarter portion of a packaging system 10 according to the invention. The system comprises a housing defining a payload compartment for holding a payload (shown in FIG. 2) and a cooling system to help maintain the payload within an acceptable temperature range.

The housing may comprise a bottom wall, a top wall located above and in spaced vertical alignment with the bottom wall, and side walls extending vertically between the bottom wall and the top wall.

The cooling system comprises one or more arrays of cold heat pipes, one or more arrays of warm heat pipes, a top layer of cold PCM material and a bottom layer of warm PCM material.

Two Sets of Heat Pipes

The cold heat pipes and the warm heat pipes circulate phase change materials (PCMs) throughout the payload compartment and preferably along the interior walls of the housing.

Preferably, each cold heat pipe is shaped like an inverted "U" and comprises a horizontal section connecting two downwardly extending legs or vertical sections 26, 28. The cold heat pipes may be arranged in a first parallel array and a second parallel array orthogonal to the first parallel array so that they contact all four sides of the housing 12. The cold heat pipes may be secured to the sides 18 of the housing with cross braces 11 or by any suitable means. The cold heat pipes may be made of a thermally conductive material such as aluminum or copper, and contain a cold phase change material. A first "cold" phase change material (PCM) is located within each cold heat pipe.

Preferably, each warm heat pipe may be shaped like a right-side-up "U", and comprise a horizontal section connecting two vertical sections. The warm heat pipes may be arranged in a first parallel array and a second parallel array orthogonal to the first parallel array so that they too contact all four sides 18 of the housing. The warm heat pipes may be secured to the sides of the container with cross braces 11 or by any suitable means. The warm heat pipes may be made of a thermally conductive material such as aluminum or copper, and contain a warm phase change material. A second "warm" phase change material (PCM) is located within each warm heat pipe 34.

Phase Change Material Layers

The first (or top) layer of cold PCM material 44 may comprise one or more cold phase change bottles and may be located above and in thermal contact with the horizontal section of each cold heat pipe to act as a heat sink. The cold phase change bottles that make up the cold PCM layer may contain a cold phase change material (such as water), preferably conditioned to a freezing temperature.

The second (or bottom) layer of warm PCM 54 may comprise one or more warm phase change bottles and may be located above and in thermal contact with the horizontal sections 37 of the warm heat pipes. The warm phase change bottles that make up the warm PCM layer may contain a warm phase change material preferably conditioned to a second freezing temperature that is warmer than the cold PCM freezing temperature. For example, if the cold phase change material is conditioned to a temperature of, say, 5 degree C., the warm phase change material may be conditioned to a freezing temperature of 23 degree C.

Thus, in the example above, the first "cold" PCM changes phases (freezes) at 5 C (41 F) and the second "warm" PCM changes phases (freezes) at 23 C (72 F).

In another example, a packaging system for maintain a payload at temperature between 15 C (59 F) and 25 C (77 F) may comprise a first "cold" PCM that changes phases (freezes) at a temperature close to 15 C (such as 17 C) and a second "warm" PCM that changes phases (freezes) at a temperature close to 25 C (such as 23 C). Thus the second PCM freezes at a temperature above the freezing temperature of the first PCM.

Phase change bottles typically are rigid structures that contain a phase change material. The phase change material may be a liquid, a solution, a gel, a semi-solid or any suitable form of phase change material.

Instead of phase change bottles, the first (or top) layer of cold PCM material 44 and/or the second (or bottom) layer of warm PCM 54 may comprise any suitable containment device or devices. For example, the first (or top) layer of cold PCM material 44 and/or the second (or bottom) layer of warm PCM 54 may comprise one or more phase change bricks (i.e., structures comprising a porous core such as expanded foam, typically having a three dimensional brick-like shape, saturated with a phase change material and wrapped in an envelope typically made of polyethylene film).

Thermally Conductive Plates

The system may further comprise a first (top) thermally conductive plate of metal or nonmetal. The top plate should be in thermal and/or physical contact with the cold phase change layer and the cold heat pipes to facilitate the transfer of thermal energy between the cold phase change layer and the cold heat pipes. For example, the cold heat pipes may be welded to the plate or they may be embedded (pass through channels) in the plate.

The system may further comprise a second (bottom) warm thermally conductive plate. The bottom plate may be metal or nonmetal. The bottom plate 56 should be in thermal and/or physical contact with the warm phase change bottles 54 and the warm heat pipes to facilitate the transfer of thermal energy between the warm phase change bottles 54 and the warm heat pipes. For example, the warm heat pipes 34 may be welded to the plate or they may pass through channels in the plate.

Principle of Operation

In general, heat pipes are enclosed pipes, sealed at both ends, that contain a fluid that transfers heat (to or from the heat pipe) via the heating and cooling of the fluid. In absorbing or transferring heat, the fluid may undergo a phase change. For example, the fluid may change from a liquid to a gas upon absorbing heat and then change back to a liquid upon giving off heat. The liquid may flow through the pipe due to gravity or some sort of wicking or capillary action.

Figure 2:
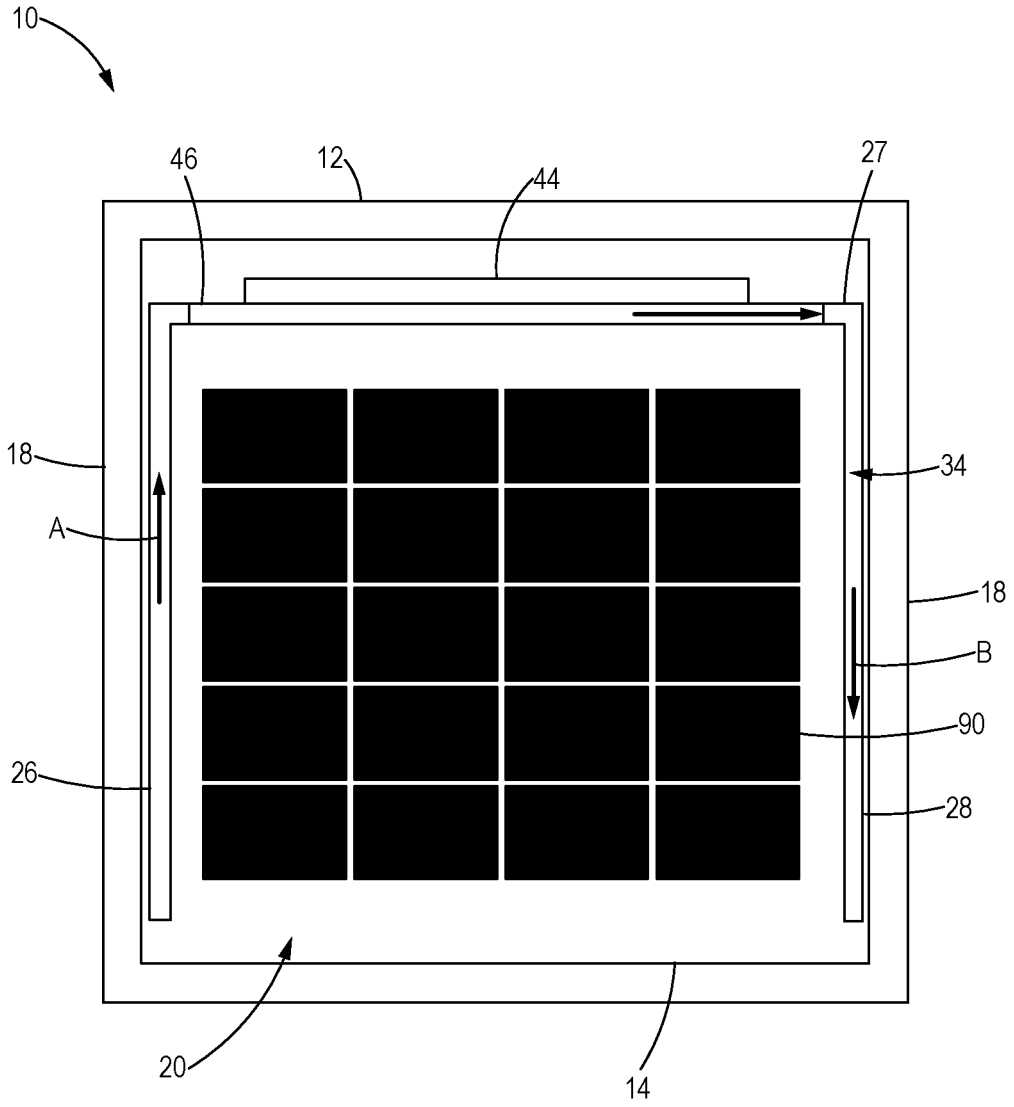
FIG. 2 is a cutaway front view of a packaging system according to the disclosure.

FIG. 2 is a cross-sectional schematic view of the system showing one cold heat pipe. Heat passing through the container sidewalls is absorbed by the first PCM inside the first and second vertical sections of the cold heat pipe (i.e., the "legs" of the inverted "U"). As the first liquid PCM inside the vertical sections is heated, the liquid PCM will start evaporating. As the first PCM liquid evaporates it will remain at about its evaporation temperature, and thus help maintain the temperature of the cold heat pipe at the phase change temperature of the first "cold" PCM, say, 5 C. As the first "cold" PCM evaporates, it will rise through the vertical sections 26, 28 of the cold heat pipe due to its lower density. For example, the evaporated first PCM in the first vertical section 26 will rise in the direction of arrow A. Likewise, the evaporated first PCM in the other vertical section 28 will rise in the same upward direction.

The evaporated first PCM rises until it enters the horizontal section of the cold heat pipe. There, the first PCM inside the cold heat pipe begins to condense as it is cooled by the layer of cold PCM bottles 44. As the first PCM inside the cold heat pipe condenses it transfers thermal energy to the layer of cold PCM material 44 (e.g. PCM bottles 44) while maintaining a constant temperature, which also helps maintain the payload compartment at a constant temperature. At the same time, the cold PCM material 44 will start melting.

The condensed liquid first PCM inside the cold heat pipe trickles down one or both of the vertical sections of the cold heat pipe, for example, in the direction of down arrow B in FIG. 2. The condensed liquid first PCM may flow down due to gravity and/or capillary action. The evaporation/condensation process then begins again, as the liquid first PCM in the vertical sections begins to evaporate again.

Thus, by going through a liquid-gas-liquid cycle, the first "cold" PCM helps maintain a narrow temperature range within the payload compartment as it circulates within each cold heat pipe. This process continues until the phase change material in the layer of cold PCM material 44 has been exhausted. The layer of cold PCM material 44 is the only component of the system that needs to be replaced or reconditioned at the end of a shipping operation.

In a similar fashion, evaporated second "warm" PCM in the first and second vertical sections of the warm heat pipes will start to licompartment uefy as it is cooled. As the second PCM inside the vertical sections is cooled, the liquid second PCM 39 will begin to trickle down one or both of the vertical sections of the warm heat pipe. When the warmed second PCM contacts the layer of warm PCM material 54 it will begin to evaporate and the warm PCM material 54 will start melting. As the second PCM evaporates it will remain at about its evaporation temperature, and thus help maintain the temperature of the warm heat pipe at the phase change temperature of the second PCM, say, room temperature (about 22 C). As the second PCM evaporates, it will rise through the vertical sections of the warm heat pipe, where the cycle will begin again. Thus, by going through a liquid-gas-liquid cycle, the second PCM maintains a somewhat constant temperature as it circulates within the warm heat pipe. In this way a closed phase change cycle is setup for warming the payload. This process continues until the PCM in the layer of warm PCM material 54 has been exhausted.

Liquid PCM May Move Within the Heat Pipes Via Capillary Action

Figure 3:
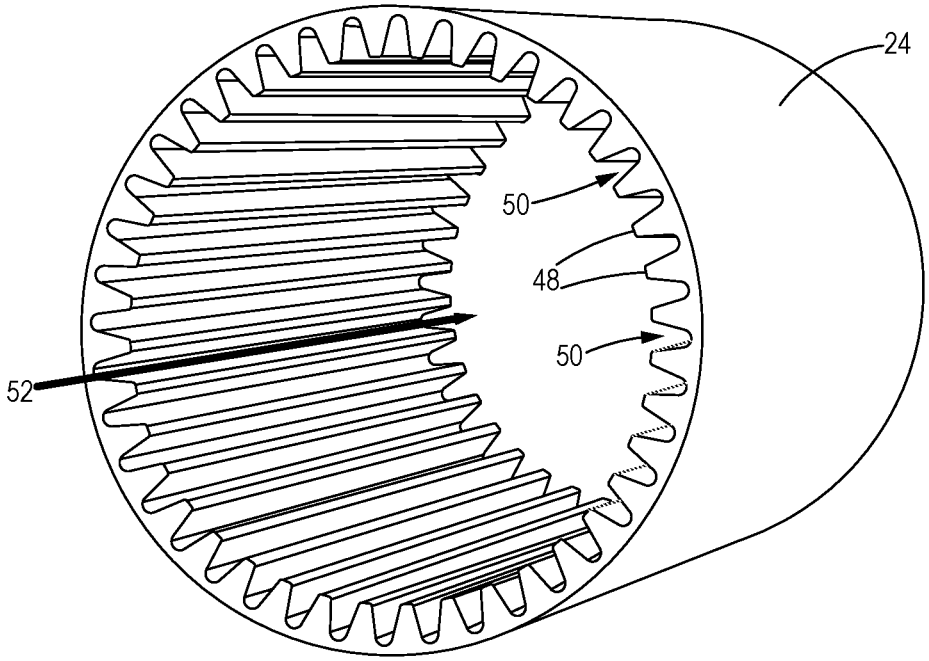
FIG. 3 is a cutaway perspective view of a heat pipe according to the disclosure.

FIG. 3 is a perspective view of a section of a cold heat pipe showing an inner surface 49 with ridges 48. The ridges 48 define grooves 50 that encourage capillary action that helps the liquid first PCM flow down the pipe. First PCM vapor or gas may travel up the pipe via a center channel 52. The warm heat pipes may have similar ridges 48 and grooves 50.

Alternative Embodiment

Figure 4:
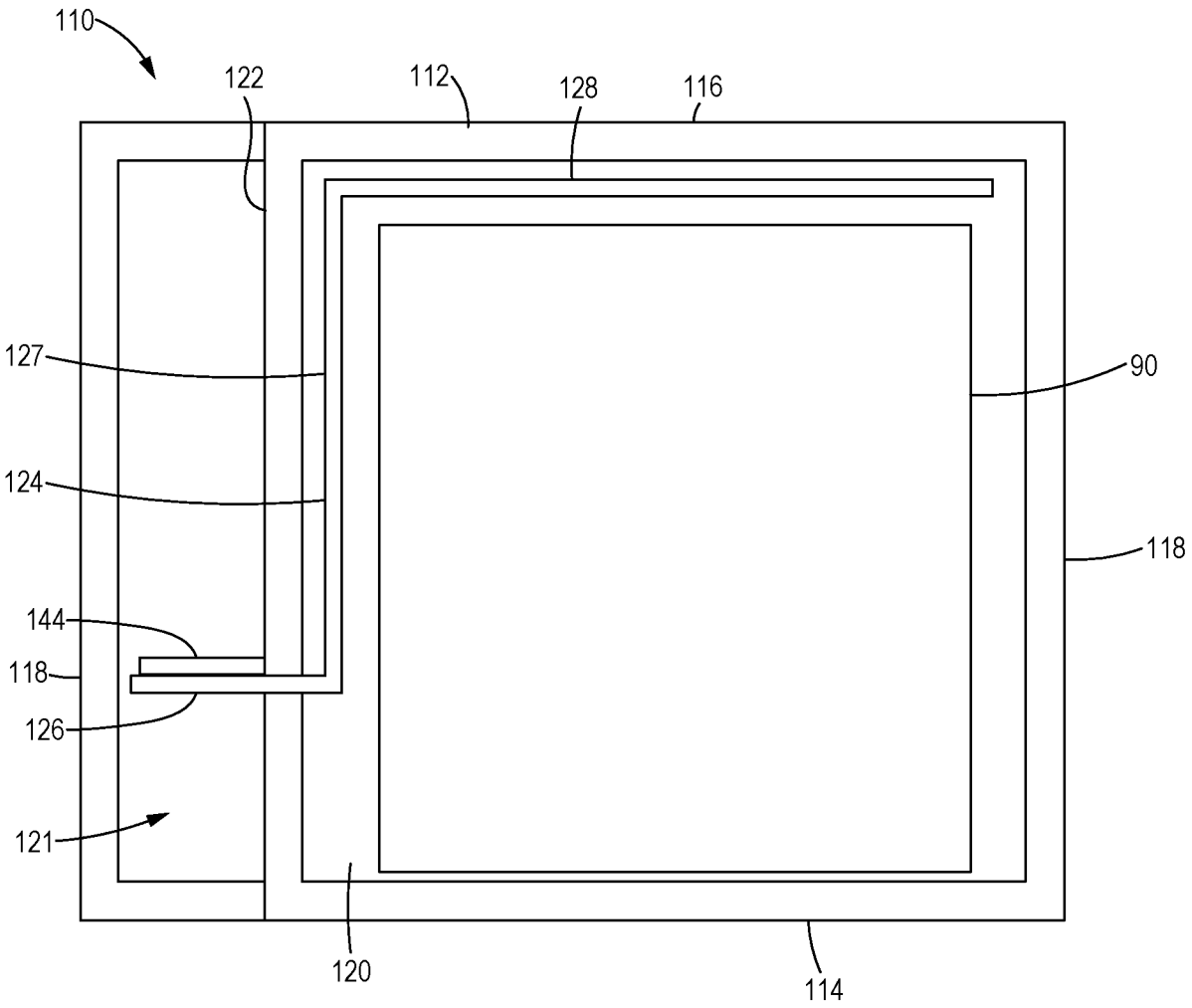
FIG. 4 is cutaway front view of an alternative packaging system according to the disclosure.

FIG. 4 is cutaway front view of an alternative packaging system 110 according to the disclosure. The system 110 comprises a housing 112 defining a payload compartment 120 for holding a payload and a cooling system to help maintain the payload within an acceptable temperature range.

The housing 112 may comprise a bottom wall 114, a top wall 116 located above and in spaced vertical alignment with the bottom wall 114, and side walls 118 extending vertically between the bottom wall 114 and the top wall 116. An internal wall 122 may separate a payload compartment 120 from a refrigerant compartment 121.

The cooling system comprises one or more arrays of cold and/or warm heat pipes 124, and one or more refrigerants 144. Instead of a U-shape, the heat pipes 124 may have any suitable shape, such as the S-shape shown in FIG. 4.

Each heat pipe 124 may comprise a lower horizontal section 126 having an end located in the refrigerant compartment 121, an upper horizontal section located in the payload compartment 120 and a vertical section 127 connecting the lower horizontal section 126 to the upper horizontal section 128. The first or lower horizontal section 126 functions as the condensation section and the second or higher horizontal section 128 functions as the evaporation section of the heat pipe 124.

A first refrigerant 144 may be located in the refrigerant compartment 121 adjacent to and in thermal contact with the first horizontal heat pipe section 126 to act as an evaporator. The first refrigerant 144 may comprise one or more phase change bottles.

When the phase change material circulating through the heat pipe 124 reaches the lower section 126, it evaporates to form a gas and begins to rise through the heat pipe 124 until it reaches the upper horizontal section 128. When the phase change material reaches the upper section 128, it condenses and begins to flow downward through the heat pipe 124 until it reaches the lower horizontal section 126.

Optionally, a second array of heat pipes and a second refrigerant (not shown) may be used. The second array of heat pipes may be charged with a second phase change material having a phase change temperature different that that the of the first array 124.

Thus, in one embodiment, a plurality of cold heat pipes are arranged in a first parallel array and a plurality of warm heat pipes are arranged in a second parallel array orthogonal to the first parallel array, preferably with both sets of heat pipes contacting all four sides of the housing 112. The cold heat pipes and the warm heat pipes may be secured to the side walls 116 and, where needed, to the top wall 114, with cross braces (not shown) or by any suitable means.

It is understood that the embodiments of the invention described above are only particular examples which serve to illustrate the principles of the invention. Modifications and alternative embodiments of the invention are contemplated which do not depart from the scope of the invention as defined by the foregoing teachings and appended claims. It is intended that the claims cover all such modifications and alternative embodiments that fall within their scope.

The invention claimed is:

1. A packaging system for shipping a temperature sensitive payload, the packaging system comprising:

a housing comprising a bottom wall, a top wall located above and in spaced vertical alignment with the bottom wall, and side walls extending vertically between the bottom wall and the top wall, the housing defining a payload compartment for holding the payload;

a cooling system comprising one or more arrays of cold heat pipes, one or more arrays of warm heat pipes, a top layer of cold phase change material (PCM) and a bottom layer of warm PCM material;

each array of cold heat pipes located within the housing and comprising one or more cold heat pipes, each cold heat pipe shaped like an inverted "U" and comprising a horizontal section connecting two downwardly extending vertical sections;

each array of warm heat pipes located within the housing and comprising one or more warm heat pipes, each warm heat pipe shaped like a "U" and comprising a horizontal section connecting two upwardly extending vertical sections;

a first phase change material (PCM) located within each cold heat pipe, the first phase change material conditioned to a first temperature at which the first PCM changes phase between liquid and gas;

a second phase change material (PCM) located within each warm heat pipe, the second phase change material conditioned to a second temperature that is warmer than the first temperature at which the second PCM changes phase between liquid and gas;

the top layer of cold phase change material is disposed above the payload compartment and in thermal contact with the horizontal section of each cold heat pipe, and the first PCM evaporates in the vertical sections due to heat transferred from the payload, rises into the horizontal section and transfers heat to the top layer of cold phase change material; and the bottom layer of warm phase change material is disposed below the payload compartment and in thermal contact with the horizontal section of each warm heat pipe and the second PCM evaporates in the horizontal section due to heat transferred from the bottom layer of warm phase change material, rises into the vertical sections and transfers heat to the payload.

2. The packaging system of claim 1 further comprising:

a first thermally conductive plate in thermal contact with the top layer of cold phase change material.

3. The packaging system of claim 2 wherein:

the cold heat pipes are welded to the first thermally conductive plate.

4. The packaging system of claim 2 wherein:

the cold heat pipes are embedded in the first thermally conductive plate.

5. The packaging system of claim 1 further comprising:

a second thermally conductive plate in thermal contact with the bottom layer of warm phase change material.

6. The packaging system of claim 5 wherein:

the warm heat pipes are welded to the second thermally conductive plate.

7. The packaging system of claim 5 wherein:

the warm heat pipes are embedded in the second thermally conductive plate.

8. The packaging system of claim 1 wherein:

the vertical sections of each heat pipe has an inner surface that defines grooves to facilitate capillary flow of the phase change material in a condensed state.

9. The packaging system of claim 1 wherein the first PCM condenses in the horizontal section due to heat transferred to the top layer of cold phase change material, trickles down to the sections and absorbs heat from the payload.

10. The packaging system of claim 1 wherein the second PCM condenses in the vertical sections due to heat transferred to the payload, trickles down to the horizontal section and absorbs heat from the bottom layer of warm phase change material.

* * * * *